United States Patent [19]

Huber

[11] 4,438,015

[45] Mar. 20, 1984

[54] LAVATORY CLEANSING BLOCK

[75] Inventor: Otto Huber, Winterthur, Switzerland

[73] Assignee: Lever Brothers Company, New York, N.Y.

[21] Appl. No.: 408,988

[22] Filed: Aug. 17, 1982

[30] Foreign Application Priority Data

Aug. 24, 1981 [GB] United Kingdom ..... 8125733

[51] Int. Cl.[3] ..... C11D 3/37; C11D 17/00

[52] U.S. Cl. ..... 252/174.24; 252/174; 252/174.21; 252/174.23; 424/76; 524/376; 524/377; 524/378; 525/328.9

[58] Field of Search ..... 252/174, 174.23, 174.24, 252/174.21; 424/76; 524/376, 377, 378; 525/328.9

[56] References Cited

U.S. PATENT DOCUMENTS

| | | | |
|---|---|---|---|
| 4,043,931 | 4/1977 | Jeffrey et al. | 252/106 X |
| 4,082,684 | 4/1978 | Kreischer | 252/109 |
| 4,269,723 | 5/1981 | Barford | 252/174 X |

FOREIGN PATENT DOCUMENTS

| | | |
|---|---|---|
| 1068554 | 5/1967 | United Kingdom . |
| 1364459 | 8/1974 | United Kingdom . |
| 1418830 | 12/1975 | United Kingdom . |
| 1534730 | 4/1979 | United Kingdom . |

*Primary Examiner*—John E. Kittle
*Assistant Examiner*—Mukund J. Shah

[57] ABSTRACT

Improved lavatory cleansing blocks of the "naked" type and a process for preparing such blocks are disclosed. The lavatory cleansing blocks comprise as a solid carrier base a mixture comprising a major proportion of a nonionic surface-active compound and a minor proportion of a partially esterified copolymer of vinylmethyl ether and maleic anhydride (PVM/MA).

The lavatory cleansing blocks, which have improved solubility characteristics, a satisfactory gelling/swelling property for good sticking to the bottom of the cistern and a specific gravity of amply above 1, are used for immersion in the water of the cistern of lavatory bowls or urinals.

6 Claims, No Drawings

LAVATORY CLEANSING BLOCK

This invention relates to blocks or tablets for cleansing lavatories and urinals and to a process for the preparation thereof. More particularly this invention is concerned with cleansing blocks which are immersed in the flush-water cistern of a lavatory bowl or urinal and are slowly dissolved in the water of the cistern, thereby to release active ingredients contained in the blocks to the water, which active ingredients serve to assist in cleansing the lavatory bowl or urinal when water from the cistern is flushed into the lavatory bowl or urinal. Optionally the blocks may also supply to the flush water one or more colouring agents, water-softening agents, perfumes and/or germicidal agents.

In one type of such cleansing blocks, the block is contained in a suitable container, e.g. of a water-impervious material, so that the blocks are not eroded away too quickly and a more or less metered dose of detergent and/or other ingredient is released to the flush water.

The present invention is concerned especially with blocks of the so-called "naked" type, i.e. cleansing blocks or tablets which do not involve the use of such a container and can be immersed directly in the water of the cistern. Such cleansing blocks generally comprise a surfactant or a mixtue of surfactants as the solid carrier base.

An important aspect of lavatory cleansing blocks of the "naked" type is that their solubility characteristics should be such that the block will only dissolve slowly in the water of the cistern and thereby gradually release its active ingredients to the water of the cistern. The solubility characteristics, which involve the rate of solubility, determine the lifetime and effectiveness of the cleansing block. Blocks of this type should therefore have a certain minimum life since otherwise the user would have to replace the block too frequently.

It has been proposed to reduce the solubility rate of such blocks by incorporating substantial amounts of a hydrophobic material in the composition of the blocks, as disclosed in British Patent Specification No. 1,543,730 and British Patent Specification No. 1,364,459.

It has further been proposed to use as the solid carrier base a mixture of a major proportion of a relatively water-insoluble surfactant, e.g. an alkanol amide of long chain fatty acids or a polyalkoxylated long chain fatty alcohol containing up to 6 moles of alkoxide, and a minor proportion of a relatively soluble surfactant, as disclosed in British Patent Specification No. 1,418,830.

The use of hydrophobic materials or other agents known to reduce the rate of solubility, however, may give rise to unsightly flocculation in the cistern and the flush water, adhering to the side walls of the lavatory bowl. Moreover, these agents, unless used in relatively high proportions, are insufficiently effective to improve the solubility characteristics of the blocks.

Apart from the above drawback little attention has been paid in formulating a lavatory cistern cleansing block of the "naked" type to the density and the swelling/gelling properties of the block. The result is that hitherto lavatory cleansing blocks of the naked type, being deficient in some aspect or other, have never been a commercial success.

A proper density is required to allow the block to sink to and remain at the bottom of the cistern on immersion in the water. A satisfactory swelling/gelling property is required for a good sticking to the bottom of the cistern, which avoids sliding from one place to another by water movement on every flushing and filling cycle of the cistern.

It has now been found that a lavatory cleansing block having improved solubility characteristics can be prepared by using as a solid carrier base a mixture comprising a major proportion of a nonionic surface-active compound and a minor proportion of a partially esterified copolymer of vinyl methyl ether and maleic anhydride.

The nonionic surface-active compounds usable in the practice of the invention are those relatively water-soluble alkylene oxide condensation products obtained from the interaction of lower alkylene oxides, particularly ethylene oxide, with a hydrophobic compound having at least one reactive hydrogen, which are solid at room temperature. Examples thereof are the ethylene oxide condensates of higher alkyl phenols, higher fatty alcohols, higher alkyl mercaptans, higher aliphatic amides, fatty acid alkanolamides, polypropylene oxides or polybutylene oxides having more than 20 ethylene oxide units per molecule. A nonionic surface-active compound that has been found especially useful in the present invention is a $C_{16}$–$C_{18}$ fatty alcohol condensed with about 50 ethylene oxide units ("$C_{16}$–$C_{18}$ fatty alcohol/50 EO").

The partially esterified copolymers are derived from copolymers or interpolymers of vinyl methyl ether and maleic anhydride (PVM/MA), which can be represented by the following general formula:

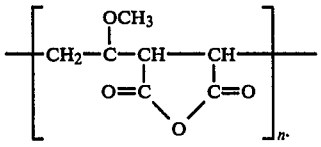

The molecular weights of said copolymers may range from about 400 to more than 2,000,000. Viscosity measurements are commonly used as an indication of the average molecular weight of the polymeric composition. Preferred copolymers have specific viscosities of between 0.1 and 2.0, particularly between 0.1 and 1.0. The specific viscosity is determined on a solution of 1 gram of the copolymer in 100 ml of methylethyl ketone at 25° C. in a Cannon-Fenske viscosimeter.

These copolymers (PVM/MA) are commercially available under the trade name of Gantrez ®, supplied by the General Aniline & Film Corporation in various grades, such as for example listed below with increasing molecular weights:

| | |
|---|---|
| Gantrez AN - 119; spec.visc. 0.1–0.5 | low molecular weight grade |
| Gantrez AN - 139; spec.visc. 1.0–1.4 | medium molecular weight grades |
| Gantrez AN - 149; spec.visc. 1.5–2.0 | medium molecular weight grades |
| Gantrez AN - 169; spec.visc. 2.6–3.5 | high molecular weight grade. |

The partial esters employed in the present invention are obtained by partial esterification of PVM/MA with a compound, preferably a surfactant, containing at least one reactive hydroxyl radical in its molecule. Anionic or nonionic reactive surfactants may be used, though preferably nonionic reactive surfactants are used for the partial esterification of PVM/MA.

Accordingly the invention provides a lavatory cleansing block having improved solubility characteristics, characterized in that it comprises as a solid carrier base a mixtue comprising a major proportion of a nonionic surface-active compound and a minor proportion of a partially esterified copolymer of vinyl methyl ether and maleic anhydride.

Preferably the same nonionic surface-active base compound is used for the partial esterification of the copolymer.

PVM/MA partially esterified with $C_{16}$–$C_{18}$ fatty alcohol/50 EO has been found particularly suitable for use in the present invention.

In a preferred embodiment of the invention, therefore, the solid carrier base comprises a mixture of $C_{16}$–$C_{18}$ fatty alcohol/50 EO and a partial ester of PVM/MA and $C_{16}$–$C_{18}$-fatty alcohol/50 EO.

Processes for the partial esterification of PVM/MA with hydroxy compounds have been described in the literature.

If PVM/MA partially esterified with the nonionic surface-active base compound is used, it can be conveniently prepared in situ during the manufacture of the lavatory cleansing block composition.

Preferred partial esters are those derived from low to medium molecular weight PVM/MAs having a specific viscosity of from about 0.1–2.0, determined on a solution of 1 gram of the PVM/MA in 100 ml of methylethyl ketone at 25° C.

In addition to the aforementioned solid carrier base, the lavatory cleansing block of the invention will preferably contain a builder or a water-softening agent to minimise build-up of hard water scale on the lavatory bowl or urinal walls, and further a colouring agent, especially a blue dyestuff, which will impart a pleasing and clean appearance to the water in the lavatory bowl and function as an indicator of when the cleansing block is exhausted. Further, the cleansing block of the invention may include other useful and active ingredients such as perfumes, germicidal agents, fillers, bleaching agents etc., as desired.

Any of the usual builders, such as polyphosphates, e.g. sodium triphosphate, sodium pyrophosphate; carbonates or bicarbonates; as well as the known organic sequestering agents, e.g. sodium ethylene diamine tetraacetate (EDTA) and nitrilotriacetic acid or its alkali metal salts (NTA), may be used. As desired, threshold agents, such as the various known organic phosphonates, e.g. aminotrimethylene phosphonic acid and ethylene diamine tetra-(methylene phosphonic acid), may also be used as partial or complete replacements of the sequestering agent.

Advantageously the solid carrier base including the builder, if present, will form a major proportion by weight of the cleansing block of the invention.

Blocks of the invention may comprise:

from about 50–99% by weight of a nonionic surface-active compound;

from about 1–25% by weight of a partially esterified PVM/MA;

from about 0–45% by weight of a builder; and from about 0–25% by weight of colouring agents, perfumes and/or other minor ingredients.

The cleansing block composition of the invention may be prepared by preparing a molten mixture of the nonionic surface-active compound and the partially esterified PVM/MA, adding thereto as desired the required amounts of builder, colouring agents, perfume and/or other ingredients with constant stirring, and casting the liquid composition into moulds forming shaped tablets or blocks upon cooling, each having suitably a weight of from 20 to 150 grams, preferably from 30 to 70 grams.

It is however preferred to prepare the lavatory cleansing block of the invention via the in situ esterification of the PVM/MA with the nonionic surface-active base compound.

Accordingly the invention also provides a process for the manufacture of lavatory cleansing blocks, comprising the steps of melting a mixture of 1–25 parts by weight of PVM/MA copolymer and 50–99 parts by weight of a nonionic surface-active compound, heating the melt further to raise the temperature to about 125°–140° C. and keeping it at this temperature to effect esterification, followed by cooling and casting the liquid product into forms where it solidifies upon further cooling to form blocks or tablets of about 20–150 grams.

Generally the esterification reaction is completed in 40–50 minutes, at which stage the product will have the appearance of a deep red clear liquid.

If other ingredients or adjuncts are required, these may be added to the composition before or preferably after the esterification reaction during cooling and before casting; for example, sodium triphosphate or other builders may be added when the temperature reaches about 90° C., thereafter dyestuffs and finally perfume and other heat-sensitive ingredients when the temperature is sufficiently low, e.g. at 60° C.

Lowering the esterification temperature to below 125° C. will produce blocks having a tendency to flocculate, whereas increasing the temperature of esterification to above 135° C. would tend to increase the solubility of the block, thereby reducing its lifetime on use.

A preferred esterification temperature is 128°–130° C., which will produce blocks having optimal use characteristics without flocculation tendency.

Cleansing blocks as prepared according to the invention have a satisfactory specific gravity of amply above 1, which will allow the block to sink immediately and remain at the bottom of the cistern on immersion in the water, a satisfactory gelling/swelling property for good sticking to the bottom of the cistern, and above all satisfactory solubility characteristics, i.e. long life and effective cleansing.

EXAMPLE

A formulation was made up of the following ingredients:

79.5 wt.% of $C_{16}$–$C_{18}$ fatty alcohol/50 EO 5.0 wt.% of a PVM/MA, specific viscosity 0.1–0.5

10.0 wt.% of sodium triphosphate 2.5 wt.% of a blue dyestuff, sold under the trade mark of Amidoblau A (Hoechst)

3.0 wt.% of a perfume.

The $C_{16}$–$C_{18}$ fatty alcohol/50 EO and PVM/MA copolymer were thoroughly mixed and heated slowly to melt until a liquid suspension was obtained. With careful stirring, heating was continued and the mass was kept at a temperature of about 130°–135° C. for about 40–50 minutes, during which partial esterification took place. Heating was stopped and the molten mass was allowed to cool slowly. Sodium triphosphate was added with careful stirring at about 90° C., and thereafter the blue dyestuff and perfume were added at about 60° C.

The liquid composition at 50° C. was poured into forms where it solidified upon cooling into tablets of 50 grams each.

Cistern immersion tests carried out with these 50 gram tablets showed a lifetime of 15 days, which corresponds to about 1 month under household conditions, which is quite satisfactory.

When the same formulation was prepared using an esterification temperature of 128°–130° C., the tablets obtained showed a cistern immersion test lifetime of 20 days, which corresponds to 40 days under household conditions.

We claim:

1. A process for preparing a lavatory cleansing block intended for immersion in the cistern of a lavatory bowl or urinal, comprising the steps of melting a mixture of 1–25 parts by weight of a copolymer of vinylmethyl ether and maleic anhydride (PVM/MA) having specific viscosity of between 0.1 and 2.0 and 50–99 parts by weight of a solid, water-soluble nonionic surface active compound, heating the melt further to raise the temperature to about 125°–135° C., and keeping it at this level to effect esterification to such an extent that the resulting blocks do not have a tendency to flocculate in use, followed by cooling and adding as desired builders and other ingredients before solidification, casting the liquid product into forms where it solidifies upon further cooling to form blocks or tablets of about 20–150 grams.

2. A process according to claim 1, wherein the esterification temperature is from 128° to 130° C.

3. A process according to claim 1, wherein the melt is kept at the esterification temperature for about 40 to 50 minutes.

4. A process according to claim 1, wherein said PVM/MA copolymer has a specific viscosity of between 0.1 and 1.0.

5. A process according to claim 1, wherein said nonionic surface-active compound is a $C_{16}$–$C_{18}$ fatty alcohol condensed with about 50 ethylene oxide units.

6. A lavatory cleansing block produced by the process of claim 1, comprising:

(i) 50–99% by weight of a nonionic surface active compound;

(ii) 1–25% by weight of a partially esterified PVM/MA;

(iii) 0–45% by weight of a builder; and (iv) 0–25% by weight of colouring agent, perfume and other minor ingredients.

* * * * *